United States Patent [19]

Konishi

[11] 4,270,865

[45] Jun. 2, 1981

[54] EDITING PRINTER

[75] Inventor: Kazunori Konishi, Tokyo, Japan

[73] Assignee: Kokusai Denshin Denwa Co., Ltd., Tokyo, Japan

[21] Appl. No.: 858,839

[22] Filed: Dec. 8, 1977

[30] Foreign Application Priority Data

Dec. 8, 1976 [JP] Japan ..... 51-146591

[51] Int. Cl.[3] ..... B41J 5/30

[52] U.S. Cl. ..... 400/63; 400/70; 400/74; 400/697

[58] Field of Search ..... 400/63, 69, 70, 74, 400/697

[56] References Cited

U.S. PATENT DOCUMENTS

| | | | |
|---|---|---|---|
| 3,063,536 | 11/1962 | Dirks | 400/70 X |
| 3,380,568 | 4/1968 | Adams et al. | 400/63 |
| 3,706,075 | 12/1972 | Fredrickson et al. | 400/63 X |
| 3,923,137 | 12/1975 | Kashio | 400/74 X |

FOREIGN PATENT DOCUMENTS

| | | | |
|---|---|---|---|
| 786037 | 11/1957 | United Kingdom | 400/63 |
| 1399618 | 7/1975 | United Kingdom | 400/63 |
| 292418 | 8/1975 | U.S.S.R. | 400/63 |

OTHER PUBLICATIONS

IBM Technical Disclosure Bulletin "Proofreading Support System for Word Processing Machines", Rahenkamp, vol. 18, No. 10, Mar. 1976, pp. 3358–3359.

*Primary Examiner*—Ernest T. Wright, Jr.
*Attorney, Agent, or Firm*—Armstrong, Nikaido, Marmelstein & Kubovcik

[57] ABSTRACT

According to the present editing printer, a printing head can print either on the first insertion line or on the second ordinary line by the operation of a keyboard, and the characters from the keyboard are also stored in a memory. An insertion end sign "⌋" is printed at the end of the insertion characters on the first line. A group of characters from the first character to the character before the insertion end sign on the first line are inserted automatically in the second ordinary line by the aid of the memory, which provides clean output with no error after editing.

2 Claims, 9 Drawing Figures

| Fig. 2A | Fig. 2B | Fig. 2C |
|---|---|---|

| Fig.4A | Fig. 4 B |
|---|---|

EDITING PRINTER

BACKGROUND OF THE INVENTION

The present invention relates to a printer capable of editing or correcting the printed characters.

According to one prior editing printer, the printing is accomplished in the predetermined direction, and when the operator recognizes a printing error, he designates the memory address relating to the wrong printed character and substitutes the character in that address of the memory. Another prior editing printer has not only an ordinary printing line, but also an editing line, and when the operator recognizes an error, he cancells the wrong character by superimposing a special symbol over the wrong character and prints the correct character on the editing line on the portion corresponding to the wrong printed character.

However, the former has the disadvantage that the operator must count the address of the wrong character, and the latter has the disadvantage that an insertion of a plurality of characters in a single original character portion is impossible, but insertion of a single character is possible in a single original character portion.

SUMMARY OF THE INVENTION

It is an object, therefore, of the present invention to overcome the disadvantages and limitations of a prior editing printer by providing a new and improved editing printer.

It is an object of the present invention to provide an editing printer which is easy to operate and is capable of inserting a plurality of characters into a single printing position.

According to the present editing printer, a printing head can print either on the first insertion line or on the second ordinary line by the operation of a keyboard, and the characters from the keyboard are stored in a memory. An insertion end sign "⌋" is printed at the end of the insertion characters on the first insertion line. A group of characters from the first character to the character before the insertion end sign on the first line is inserted automatically in the second ordinary line by the aid of the memory, thus the clean output with no error is obtained from the memory. Preferably, a pair of memories are provided for storing the characters of the first line and the second line respectively.

BRIEF DESCRIPTION OF THE DRAWING

The foregoing and other objects, features, and attendant advantages of the present invention will be appreciated as the same become better understood by means of the following description and the accompanying drawing wherein.

DETAILED DESCRIPTION OF THE PREFERRED EMBODIMENTS

Figure 1:
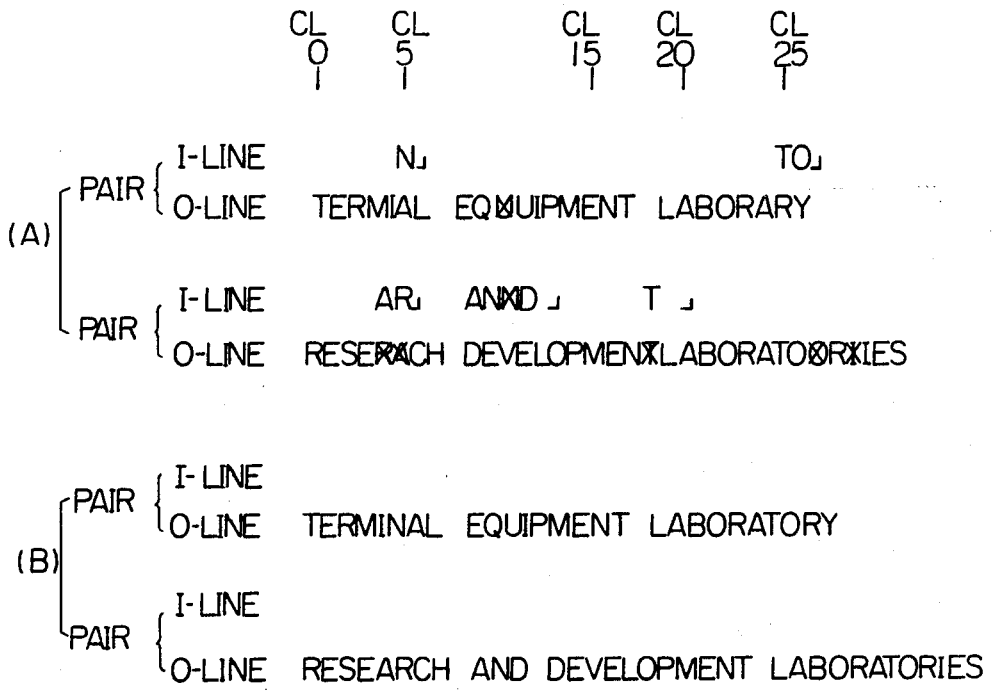
FIG. 1 shows an example of the edited printing according to the present invention.

FIG. 1 shows an example of a printing correction according to the present invention. In FIG. 1(A), showing the progress of the editing steps, each pair consists of a first line (insertion line) and a second line (ordinary line). Shown in FIG. 1(B) are the results of editing. In the present invention, the cancellation character (for instance "X") is printed on the character to be cancelled, and for insertion, the characters to be inserted are continuously printed from the above position (specifically, immediately above the character on the right of the insertion portion) and the insertion end character "⌋" is printed at the end of the inserted characters. As shown in the lower pair in FIG. 1(A), the correction procedure has a cancellation step and an inserting step, the former step being to print the cancellation character "X" over the incorrect character and the latter step being to print the correct character above, or on the right of, the cancelled incorrect character. When an error occurs in the insertion line, first the incorrect character is cancelled and then the correct character is printed on the right of the cancelled character or on the portion of the ordinary line just under the cancellation. In the upper pair in FIG. 1(A) for example, when the character N is missed between Column 4 and 5, "N" is printed on the insertion line immediately above the character A at Column 5, being followed by the end character "⌋". The same steps are taken when more than one character are missed. In the above pair, the missed characters "TO" are printed immediately above the character, R, at Column 25, followed by the end sign, "⌋", so as to be inserted between Column 24 and 25. Thus edited, the data in FIG. 1(A) results in a perfect and clear print-out as shown in FIG. 1(B). FIG. 1 is just an example that the insertion characters are inserted to the left of the first insertion character on the ordinary line.

However, the position for insertion does not have to be there, but may be at any place clearly defined by the first insertion character. The first character so used may be the first character of the insertion characters as in the above example, and its function may also be fulfilled by an insertion start sign, such as the arrow indicator, ↙. The movement of the printing head 315, as seen in FIG. 2A, is well known, therefore no description of the same is given.

Figure 2A:
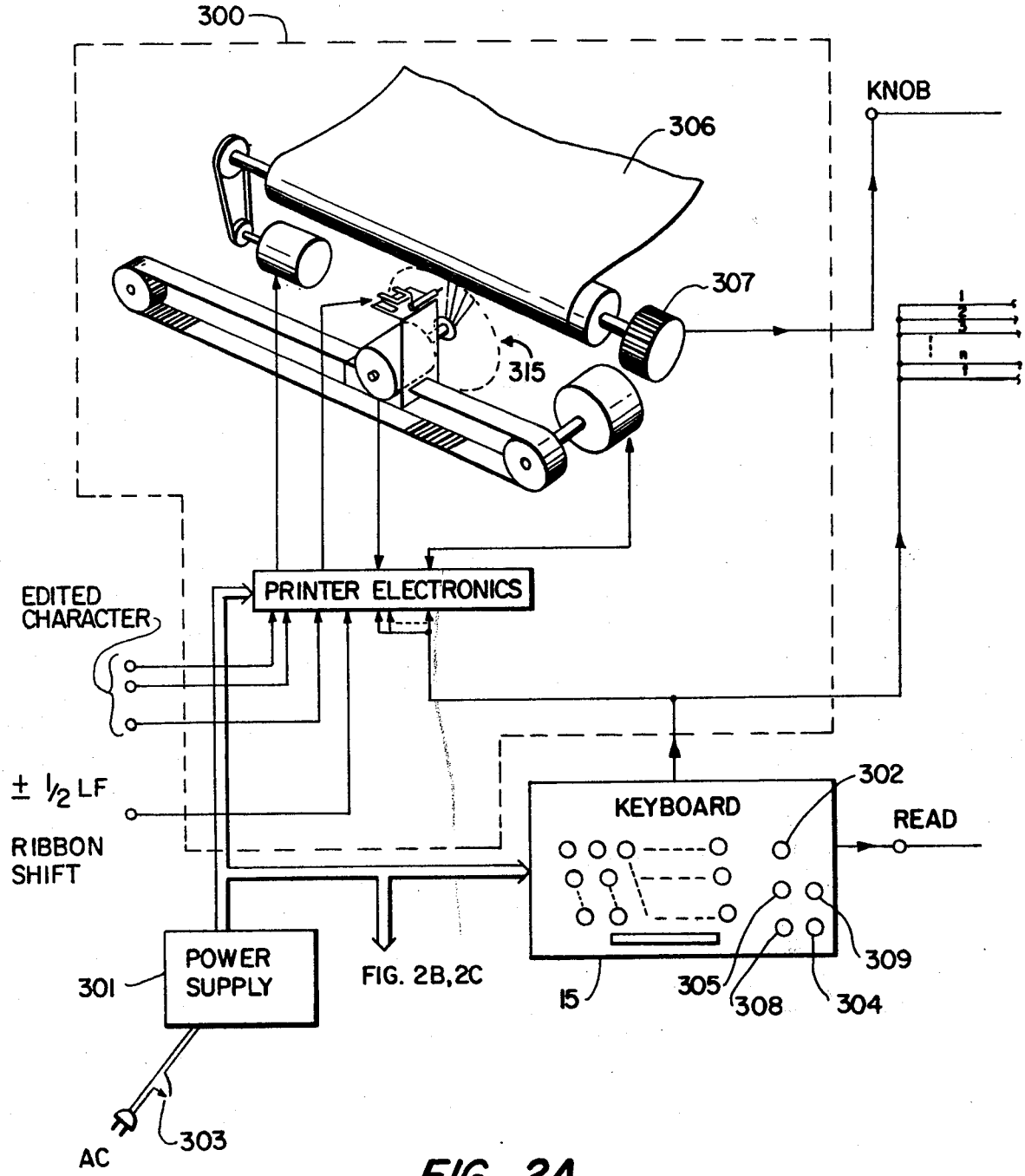
FIGS. 2, 2A, 2B, and 2C are a block diagram of an embodiment according to the present invention.
Figures 2, 2B:
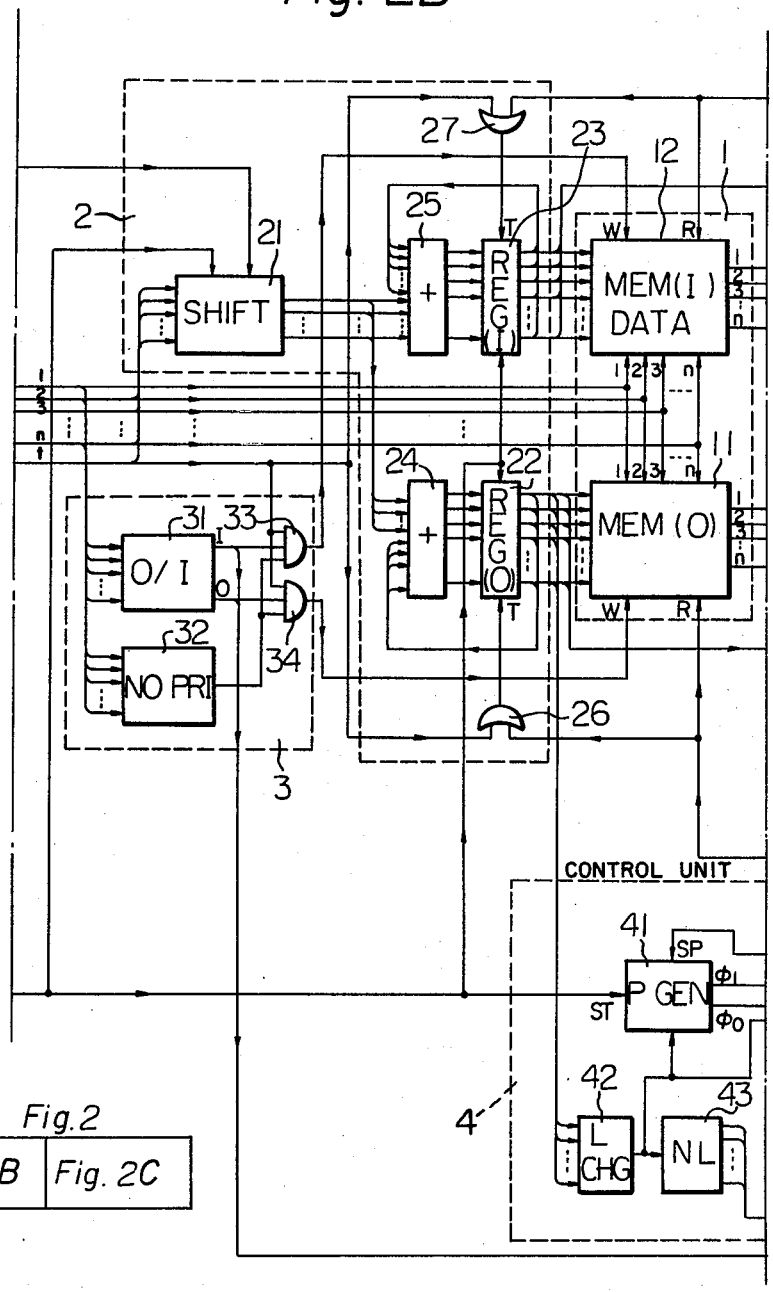
Figure 2C:
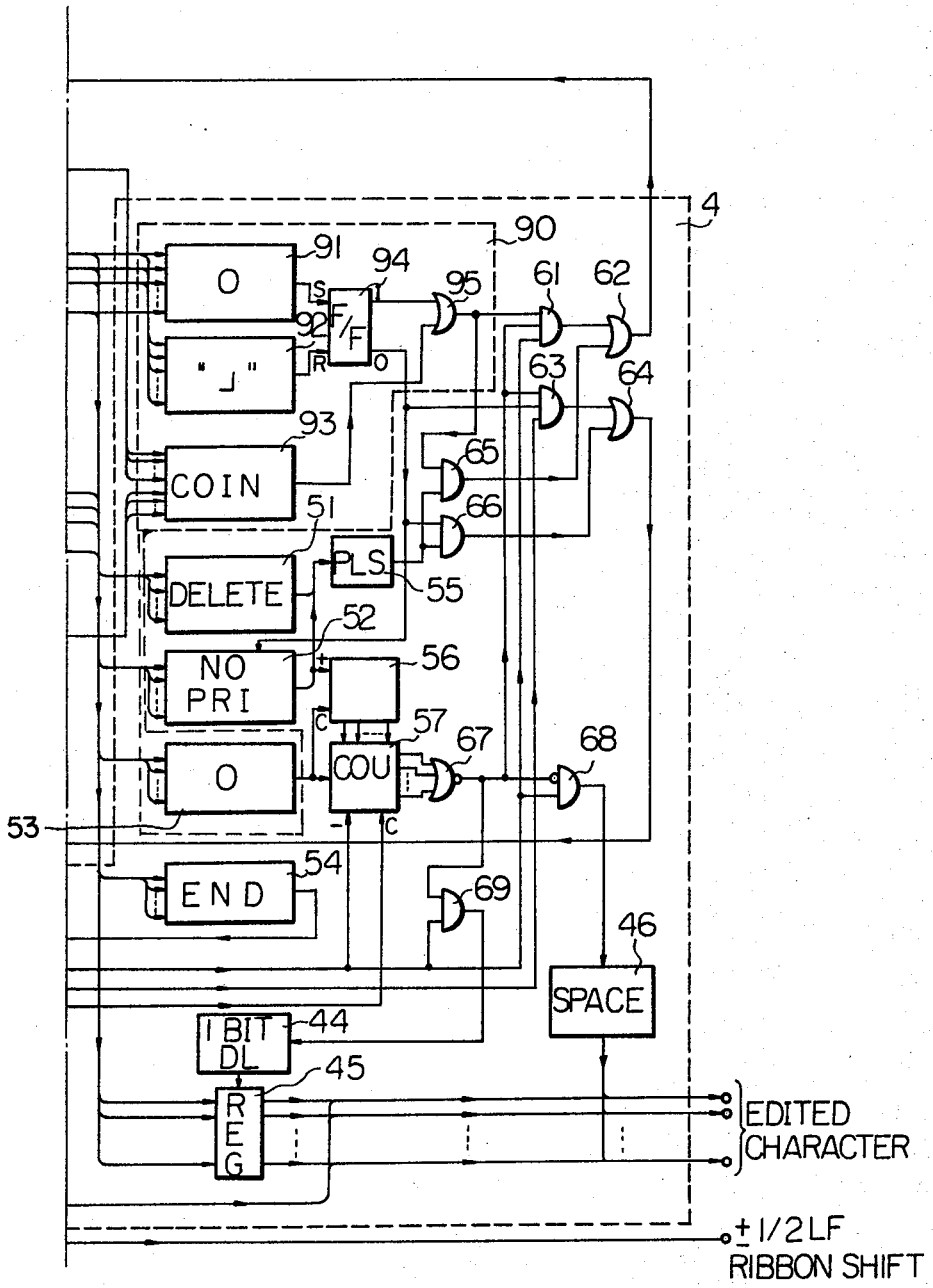

Referring to FIGS. 2A, 2B and 2C, there is provided a logic circuit for execution of the editing procedure shown in FIG. 1, comprising a memory 1, an address circuit 2, a print and memory line control 3 and an editing control 4. Particularly for the editing control 4, as will be described later, a read-out sequence control 90 is provided. The logic circuit is connected to a conventional printer 300.

Figure 3:
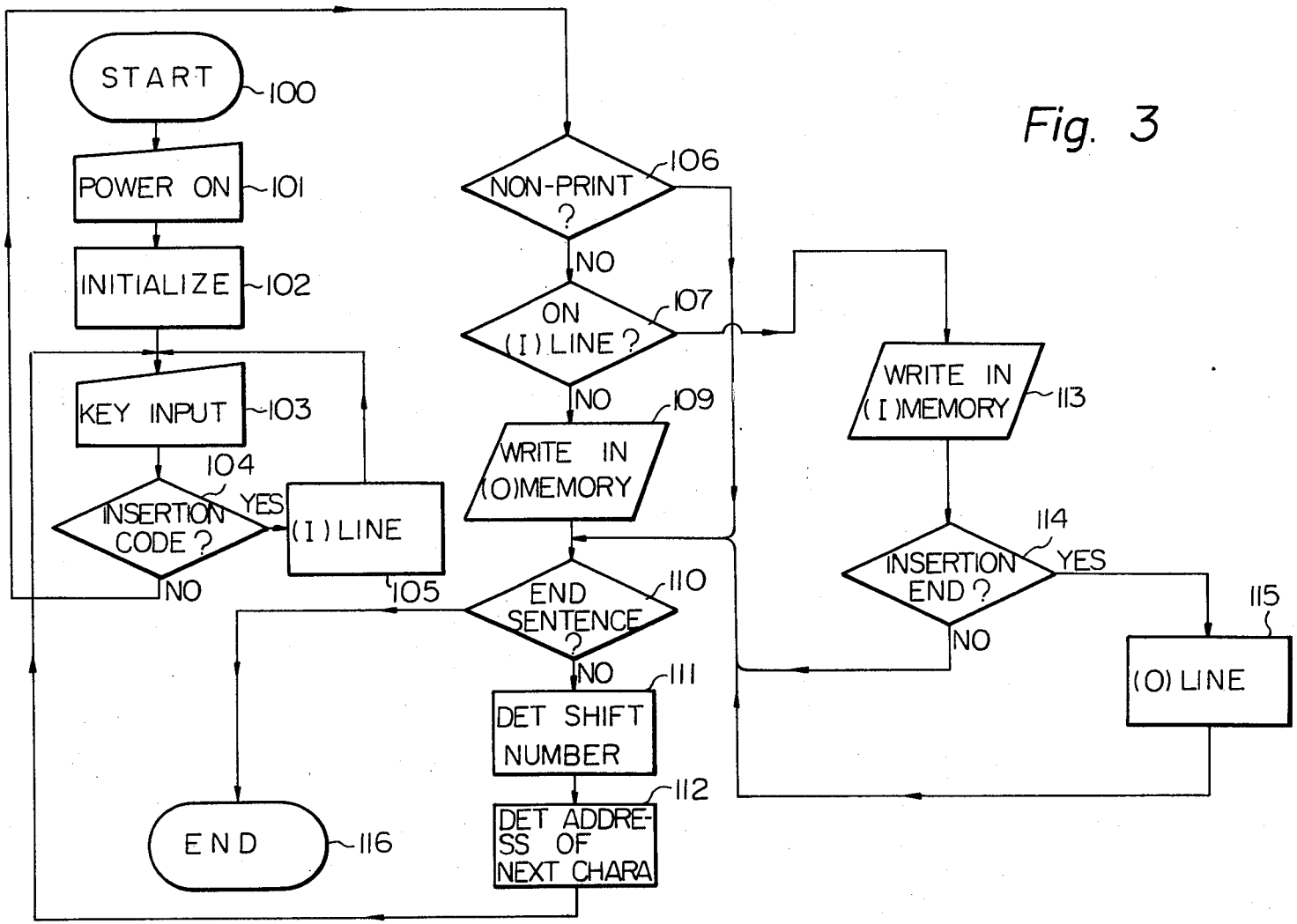
FIG. 3 is a flow chart illustrating the character code storing process in the above embodiment.

FIG. 3 shows a sequence of storing signals from the keyboard in the memory 1. The steps for the sections in FIG. 3 are shown in Table 1. When the power supply is turned on in the editing printer 300, the following members in FIGS. 2A, 2B and 2C are all cleared and initialized:

- Ordinary line memory (hereinafter called "O line memory")
- 11 and an insertion line memory (hereinafter called "I line memory")
- 12 in the memory 1;
- Register (O) (hereinafter called "O register") 22 and a register (I) (hereinafter called I register) 23 in the address circuit 2.

TABLE 1

| Number | Item |
|---|---|
| 100 | Start |
| 101 | Power supply on |
| 102 | Clearing of the memories and others, and selection of the ordinary line |
| 103 | Input at the keyboard |
| 104 | Insertion line selecting code ? |
| 105 | Selection of the insertion (I) line |
| 106 | Non-print characters ? |
| 107 | On the insertion line ? |
| 109 | Writing into the ordinary (O) line memory |
| 110 | End of a sentence |
| 111 | Determination of a shift number |
| 112 | Determination of the address of a next character |
| 113 | Writing into the insertion (I) line memory |
| 114 | End of insertion ? |
| 115 | Selection of the ordinary (O) line |
| 116 | End |

Also cleared are an ordinary insertion line selecting circuit 31 (hereinafter called "line selecting circuit") in the line control 3 and a flip-flop (FF) 94, in the read-out sequence control 90, which functions to display character insertion, and the output signal is generated at the O terminal of the flip-flop 94 for indicating the ordinary line. Furthermore, a pulse generator 41 in the control 4 stops the oscillation. These initial settings may be done only by turning on the power supply 301. Or a keyswitch 302 may also be operated concurrently with the power switch 303.

When an operator pushes a keyswitch 302, signals of the corresponding character codes are fed from the keyboard 15 in FIG. 2A. The character codes are of "n" units and it is supposed that there is a timing signal "t", for sampling the character codes. With the power supply 301 turned on, when the first character code is fed to the input, the line selecting circuit 31 produces output at the terminal O, preparing the O line memory 11 for storage of the input character codes.

When the first signal is an insertion line selecting code instructing ½BLF (back line feed), of the printing head 315, for printing a character on the insertion line, neither of the terminals O and I in the line selecting circuit 31 produce outputs until the timing signal "t" finishes and after the timing signal "t" stops, the terminal I provides output. The timing signal "t" is blocked by the AND circuits 33 and 34 and is not passed to the write terminal W which is for the O line memory 11 and the I line memory 12. Consequently, the insertion line selecting code (½BLF) is not stored in either memory 11 or 12. The insertion line selecting code (½BLF) is sent to the shift number determining circuit 21 which produces the zero output so that the adders 24 and 25 in turn may still produce the zero output. On the other hand, the timing signal "t", after passing through the OR circuits 26 and 27, actuates the O register 22 and the I register 23, and causes the O output value of the adders 24 and 25 to be stored in the O register 22 and the I register 23, respectively. FIGS. 2A, 2B and 2C show a memory storage arrangement in which the position of the printing head 315 in the printing mechanism corresponds simply to the address of the memory 1 so that the shift number determining circuit 21 and the line selecting circuit 31 may produce the outputs of the shift number and the memory selecting signal corresponding to the shift length of the printing head 315.

For the non-printing instruction codes from the keyboard 15, such as SP (space), BS (back-space), CR (carriage-return), LF (line-feed) and BLF (back-line-feed), the non-character code detection circuit 32 in the line control 3 produces an output and the AND circuit 33 and the AND circuit 34 are closed so that such instruction codes may not be stored in the memory 1. If the non-printing instruction codes were also stored in a memory during the editing procedure, the non-printing instruction codes would be written in the memory even during the step of shifting the printing head 315 back to the position of an error while the stored characters would be erased, thus the editing procedure would be spoiled. Should the non-printing instruction codes be stored, an additional key would become necessary merely for shifting the printing head 315 back to the error position (said additional key signal is never stored in the memory), and this key would always have to be used for any shifting step, which would complicate the printer operation.

When the signal of an ordinary character is given to the input of the keyboard 15, with the printing head 315 on the insertion line, a positive voltage output is provided at the terminal I in the line selection circuit 31 (positive logic, and the same logic will apply hereinafter), permitting the ordinary character to be stored in the address indicated by the I register 23 of the I line memory 12. In this case, if the printing head 315 is on the ordinary line instead of on the insertion line positive voltage output is provided at the terminal O in the line selection circuit 31, and the orindary character is stored in the O line memory 11. In the arrangement in FIGS. 2A, 2B and 2C, the timing signal "t", upon passing through the OR circuits 26 and 27, actuates the O register 22 and the I register 23 simultaneously, and as the input signals to both registers 22 and 23 are the same, the address of the O line memory 11 and the I line memory 12 are the same for writing the character codes from the keyboard 15 into the memory 1. That is, the ordinary character and the insertion character, when they are on the same pair of lines and in the same column, are to be stored respectively in the O line memory 11 and the I line memory 12, both of the same address, respectively.

When characters are to be inserted insertion key 308 is pushed and when the desired character codes are printed on the insertion line and the key 304 for "insertion end" is pushed, as shown in FIG. 1, the insertion end sign " " is printed and the printing head 315 returns to the ordinary line after ½ LF (½ line-feed). For the return of the printing head 315 from the insertion line to the ordinary line, there may be provided an additional ordinary line selection key 305. When the printing head 315 is positioned on the ordinary line, a positive voltage is generated at the terminal O in the line selection circuit 31, permitting the selection of the O line memory 11.

The shift number determining circuit 21 functions to produce a value corresponding to the movement of the printing head. For a shift in the same columns between the same pair of lines (selection of an ordinary line by the insertion line selection code and the insertion end sign), the circuit 21 produces the O output. To be produced by the circuit 21 are these values: 1 for an ordinary character or SP (space) or an erased character, −1 for BS (back-space), a value corresponding to the number of columns for LF (line-feed), a value with the minus sign "−1" equal to the value of LF for BLF (back-line-feed), and a value, with the minus sign, corresponding to the column number of the present head position for CR (carriage return).

When the sentence end code is given by the keyboard 15, said code is stored at the address of the O or I line memory 11 or 12 in the memory 1 depending upon the present head position, permitting the character input procedure to finish. The sentence end code is not always necessary, but may be useful because the sentence end code indicates clearly where the sentence finishes.

When the signals are passed from the line selection circuit 31 to the ribbon shift mechanism (not shown), which prints the characters in black color on the ordinary line, or in another color, red for example on the insertion line. The distinction between the black and the other color is helpful in recognizing any of the ordinary character and the inserted character, particularly in identifying any character printed over the other characters.

As mentioned above, the line selection circuit 31 is actuated by the insertion line selection code or the insertion end code to feed the paper 306, from the ordinary line, to the insertion line for printing on the insertion line and back to the ordinary line. When the printing head 315 is moved in relation to the paper 306, preferably the travel distance may be one half of the distance between an ordinary line and the following ordinary line, however, it is not necessary to fix the travel distance at any value. The normal distance covered by one LF (line feed) is 1/6 inch. The setting for one Line Feed can be manually chosen by the operator from among 1 LF, 1½LF and 2 LF. For 1 LF the distance between the ordinary and insertion lines is 1/12 inch, so some portions of the ordinary character and the inserted character may be overlapped, and yet the characters themselves are sufficiently recognizable. For the settings, 1½ LF and 2 LF, the distances between the ordinary line and the insertion line are, respectively, ⅛ inch and 1/6 inch, and no overlapping may occur. If it is arranged that the LF signal should come not only from the keyboard 15 but also from the handling of the platen knob 307, such arrangement may be helpful in that the relation between the print position and the memory address remains unaffected by any handling of the knob 307. The KNOB signal from platen knob 307 provides an indication if the knob 307 has been rotated.

Figures 4, 4A:
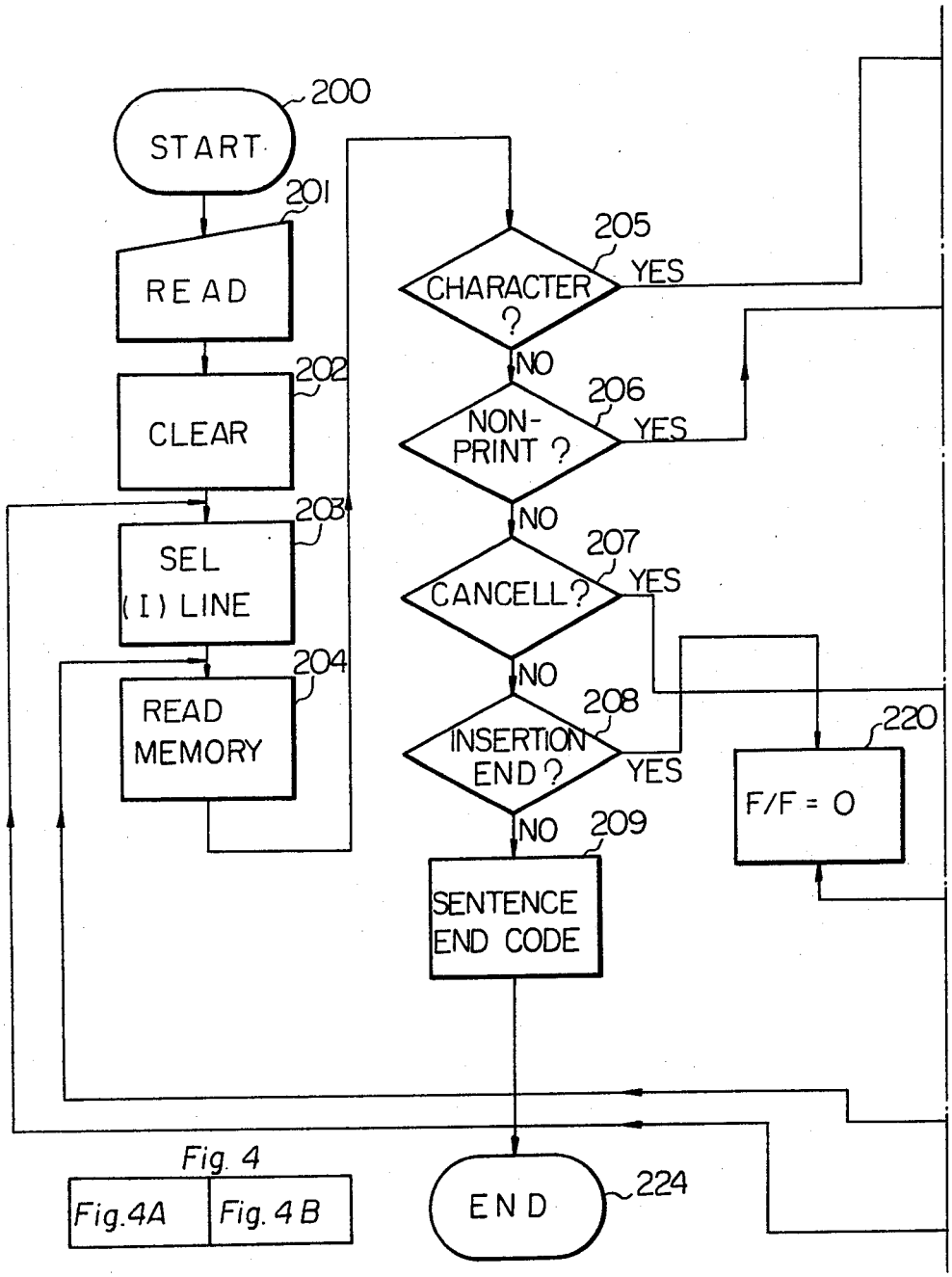
FIGS. 4, 4A and 4B are a flow chart illustrating the output process of the edited character codes in the above embodiment.
Figure 4B:
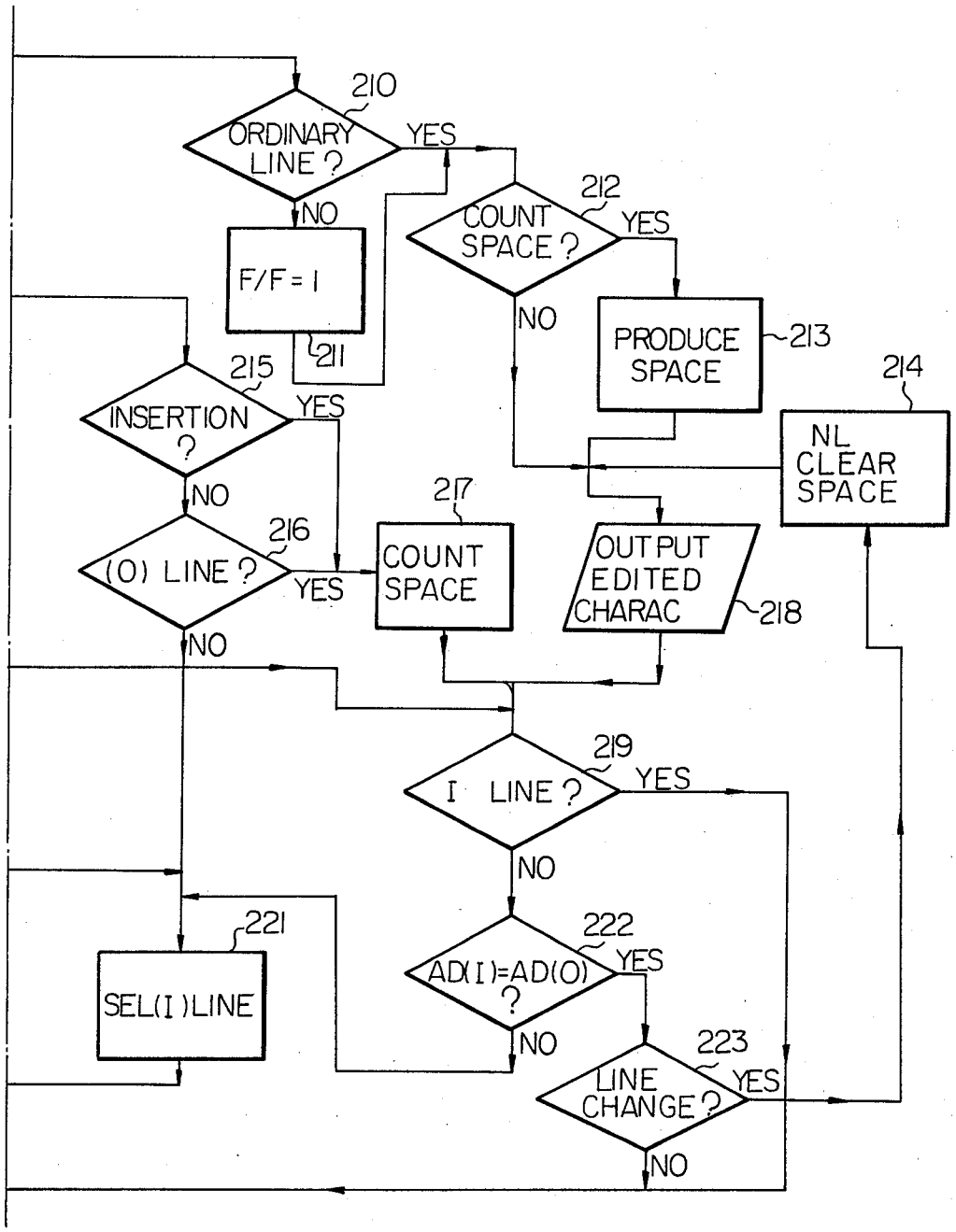

The above description is given of the character input procedure in FIGS. 2A, 2B and 2C with the aid of the flow chart in FIG. 3. Now with reference to FIGS. 4A and 4B, a description will be given concerning the editing control 4 shown in FIGS. 2A, 2B and 2C, particularly of the process of obtaining correct character codes by the editing procedure. The operation of FIGS. 4A and 4B is shown in the table 2.

When the read out key 309 in the keyboard 15 is pushed, the read out instruction signal is supplied on the read terminal (READ) at the right end of FIG. 2A, permitting the clearance of the O register 22 and the I register 23, changing the addresses of both memories 11 and 12 in the memory 1 to zero and permitting the clearance of the flip-flop (FF) 94 which indicates that the insertion operation is continued, the counters 56 and 57, and the register 45. The above instruction signal is fed to the input of the pulse generator 41 which in turn generates two phases of oscillation pulse series $\phi_I$ and $\phi_O$. The first phase of pulse series, $\phi_I$, is for reading out the I line memory 12, and the second phase of pulse series $\phi_O$ is for reading out the O line memory 11.

TABLE 2

| Number | Item |
|---|---|
| 200 | Start |
| 201 | Read out instruction |
| 202 | Clearing of registers and others |
| 203 | Selection of the insertion (I) line |
| 204 | Reading out of a memory and registering at an address |
| 205 | Detection of characters ? |
| 206 | Non-print characters ? |
| 207 | Cancel ? |
| 208 | End of insertion ? |
| 209 | Sentence end code |
| 210 | Ordinary line ? |
| 211 | Display the insertion (F/F=1) |
| 212 | Is space measured by count ? |
| 213 | Producing space codes by a measured number |
| 214 | Providing an NL code and clearing a space value |
| 215 | "Insertion underway" ? |
| 216 | On the ordinary (O) line ? |
| 217 | Count space |
| 218 | Edited character code output |
| 219 | "Insertion underway" ? |
| 220 | Display "Not being inserted" (F/F=0) |
| 221 | Selection of the ordinary (I) line |
| 222 | Coincidence of the "insertion" and "ordinary" addresses ? |
| 223 | Detection of a line change ? |
| 224 | End |

The reason that the first phase of the pulse series is $\phi_I$ is, as mentioned previously, that the insertion characters are to be inserted on the lower left of the first character in other words, the insertion characters come before the ordinary characters on the same pair of lines and in the same column.

When the pulse generator 41 produces the first read out pulse, both the outputs of the O register 22 and the I register 23 are zero, and so the coincidence detecting circuit 93 provides a positive voltage output, which is, after passing through the OR circuit 95, applied to the input of the AND circuit 61. Since the counter 57 is already initialized to the zero value, the output terminal of the NOR circuit 67 also provides a positive voltage to the input terminal of the AND circuit 61. The first read out pulse $\phi_I$ fed into the AND circuit 61, is passed from the AND circuit 61 through the OR circuit 62 to the read out clock terminal R in the I line memory 12. Thus, the first read out clock pulse $\phi_I$ reads out the codes of the characters for insertion, which are stored in the zero address of the I line memory 12, i.e., the codes of the characters for insertion which are in the column zero on the line of the first pair.

If the codes, thus read out, are for ordinary characters, they are detected by the ordinary character detecting circuit 91, the output of which sets the flip-flop (FF) 94 for display, "Insertion underway", providing a positive voltage at the output terminal I of the flip-flop 94.

When the pulse generator 41 produces the second phase of the read out pulse $\phi_O$, the AND circuit 63, since the output terminal of the flip-flop (FF) 94 is zero, closes, and the read out pulse is blocked and as a result, the O line memory 11 is not read out. As long as the flip-flop (FF) 94 is set for the display "Insertion underway", the read out pulse $\phi_O$ is blocked and the read out pulse $\phi_I$ continuously reads out the character codes stored in the I line memory 12.

During the memory read out step, the read out instruction functions to enable the shift number determining circuit 21 to always provide only the 1 output. Upon completion of the read-out, the rear edge of the same pulse counts up the address of the memory 1 by the value +1, and those values are retained by both memories 11 and 12.

After read-out of the ordinary characters from the I line memory 12, the insertion end detecting circuit 92 detects the end code, resets the flip-flop (FF) 94 and provides a positive voltage at the terminal O to open the AND circuit 63. Consequently, the read out pulse $\phi_O$ from the pulse generator 41, upon passing through the AND circuit 63 and the OR circuit 64, reads out the O line memory 11. As mentioned above, the memory address to be read is the sum of the +1 and the last read-out address of the O line memory 11. It is apparent from the above that the read-out sequence for the I and O line memories 12 and 11 is determined by the output of the OR circuit 95 and the output of the terminal O of the flip-flop (FF) 94 both functioning as a gate signal. Consequently, the ordinary character detecting circuit 53, the insertion end detecting circuit 92, the flip-flop (FF) 94 for display "Insertion underway", the coincidence detecting circuit 93 and the OR circuit 95 may, be considered as a read out sequence control mechanism 90. The mechanism 90 is the important feature of the present invention. The mechanism 90 operates, together with the two-phase pulse generator 41, to read out the I line memory 12 when "the insertion is underway" or when the addresses of both memories 11 and 12 coincide with each other, and to read out the O line memory 11 during no "insertion underway" and no address coincidence.

When the erasure (or cancel) sign is read out from the memory 1, the sign is detected by the erasure detecting circuit 51 and is passed to the pulse generating circuit 55 which in turn produces a pulse of a frequency higher than $\phi_I$ or $\phi_O$. This pulse, being controlled by a control signal from the read out sequence control mechanism 90, passes through the AND circuit 65 or 66 and through the OR circuit 62 or 64, and drives the memory 1. The purpose of the pulse of a higher frequency is to detain the erased codes so that the erased code, even when read out from the memory 1, may not be written into the register 45 which is actuated at the phase of the read out pulse $\phi_I$.

When a zero sign, "all null," is read from the memory 1, those under insertion by the non-character detecting circuit 52 and those on the ordinary line are read, and the number of the continuous zeros is stored at the counter 56. This number is stored, like the erased codes, with the pulse of a higher frequency produced by the pulse generating circuit 55. With the output of the read-out sequence control mechanism 90, codes are read out, one after another, from the memory 1. If an ordinary character code is found on the line of the same pair, the codes are detected by the ordinary character detecting circuit 53, the value of the counter 56 is pre-set to the counter 57, and then counter 56 is cleared. The counter 57 is a substracting counter, which loses 1 each time the read out pulse $\phi_I$ is fed to the input of the "−" terminal of the counter 57. When a series of non-character codes during the "insertion underway" or those on the ordinary line is preset to the counter 57, the output of the same is no longer zero, permitting the NOR circuit 67 to produce zero output. The "zero" output from the NOR circuit 67 closes the AND circuits 61 and 63, blocking the read out pulse $\phi_I$ and $\phi_O$. Consequently, read-out of the memory 1 is suspended until the counter 57 is changed to "zero" status. In the meantime, the read out pulse $\phi_I$ passes through the AND circuit 68 and is, upon being converted into a space code by the space code generating circuit 46, sent out as an edited signal. That is, the non-character signals during the "insertion underway" or on the ordinary line, before the reading out of the last one of the ordinary character code on the line of the same pair, are converted into space signals, which are output.

In writing a character code into memory 1, on the other hand, the carriage return operation (CR, LF or NL) without shifting the printing head 315 to the greatest column number, would result in storing the non-character codes at the rest of the column in the memory 1. In such case, it would be preferable not to send out the SP signals but to send out the CR and LF signals. For this purpose, it is necessary to check the address of the O line memory 11, for detection of the change of the line by the line change detecting circuit 42. When a line change signal is detected, it is fed to the input of the NL code generating circuit 43 to produce the CR and LF signals. Simultaneously, to block the output of SP as mentioned above, the counter 57 is cleared. Since a longer period of time is usually required for a CR/LF operation than for the ordinary printing operation, the line change signal is sent to the pulse generator 41 just to stop the production of a pulse for a period of time required for the CR/LF operation.

The ordinary character code from the memory 1 is read into the register 45 at the timing of the read out pulse $\phi_I$ for reading out the next character. When the SP code is produced by the SP code generating circuit 46, the read out pulse $\phi_I$ is gated by the AND circuit 69 to prevent the production of the ordinary character codes. The ordinary character codes, after being delayed for one bit by the one-bit delay circuit 44, is read into the register 45 and is sent out as an output.

When the sentence end code is read out from the memory 1, it is detected by the sentence end detecting circuit 54 and is passed to the pulse generator 41, to stop the generation of the read out pulses $\phi_I$ and $\phi_O$.

It is apparent from the above description in FIGS. 2A, 2B, 2C 3, 4A and 4B that the arrangement shown in FIG. 1 is practically feasible. In this arrangement, as described above, the character codes to be printed are stored in the memory address so that they can be fed in edited form as the output. It is not necessary to store the character codes exactly as they are printed. For example, character codes may be stored, one after another, as they are edited, and details of what has been done for editing, such as the position of erasure or insertion, may also be recorded. The make-up of the memory control would naturally have to be modified accordingly. Needless to say, the present invention with this editing arrangement can be accomplished by a programmed computer, instead of a wired logic circuit in FIGS. 2A, 2B and 2C.

It may happen as a result of the insertion of characters that the number of characters to be printed on single line should go beyond that capacity of the line. In such case, an automatic CR/LF device should be installed to carry over any excess characters to the next line. The device can also print a hyphen (-) and a SP (space) sign and as it blocks a line change signal, continuously printing out from the related memory.

According to the present invention, an editing procedure is easily possible by employing a memory, a simple logic circuit like a micro-computer and a printer having a travelling head. The editing printer in accordance with the present invention does not require a cathode ray tube screen, as have conventionally been employed in a prior art, and the present invention makes possible a superior editing and printing procedure with ease and at a lower cost.

From the foregoing it will now be apparent that a new and improved editing printer has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. An editing printer comprising a printing unit capable of printing characters at a given position either on an ordinary line or on an insertion line by operation of a keyboard, with a string of characters on the insertion line from the first character to the last character just before an insertion end signal comprising data to be inserted in the ordinary line as correction data, a first random access memory for storing the input characters to be printed on an ordinary line by the operation of said keyboard, a second addressable random access memory for storing the input characters to be printed on an insertion line by the operation of said keyboard, wherein the designated address of said first memory is related to a printing position on a printing line and is the same as that of said second memory except for the insertion operation, wherein only the address of said second memory is incremented by the operation of said keyboard, and a control means for controlling said memories such that the characters printed on the insertion line including the first character and the last character before the insertion end signal are inserted in the ordinary line at the position defined by said first character, said control means including logic circuit means, pulse generator means coupled to said keyboard and to said logic circuit means, ordinary character detecting means coupled to said second memory for detecting ordinary character stored in said second memory, insertion end detecting means coupled to said second memory means for detecting the insertion end signal, coincidence detecting means coupled to the inputs of said first and second memories for detecting the coincidence of the addresses of said first and second memories, the outputs of said ordinary character detecting means, said insertion end detecting means and said coincidence detecting means being coupled to said logic circuit means for controlling the printing of characters by said editing printer.

2. An editing printer according to claim 1, wherein said control means includes means for converting non-printing characters from said keyboard to a particular code, storing the particular code in said memories, the particular code in a first line for insertion being converted again to a space code to be printed, the particular code on the second line being converted again to a space code when there is a printing character on the rest of the second line, the particular code on the second line being converted to a carriage/return code when there is no printing code on the rest of the second line, and the cancel code and end signal being converted to a non-printing code.

* * * * *